US009375127B2

(12) United States Patent
Azmi et al.

(10) Patent No.: US 9,375,127 B2
(45) Date of Patent: Jun. 28, 2016

(54) SPRAY ASSEMBLY FOR A DISHWASHER APPLIANCE

(71) Applicant: General Electric Company, Schenectady, NY (US)

(72) Inventors: Mohammad Shakeb Azmi, Thane (IN); Suryanarayana Murthy Atreyapurapu, Hyderabad (IN); Madhu Sonnathi, Mahabubnagar (IN); Hiremath Nurondayya, Bangalore (IN)

(73) Assignee: General Electric Company, Schenectady, NY (US)

( * ) Notice: Subject to any disclaimer, the term of this patent is extended or adjusted under 35 U.S.C. 154(b) by 377 days.

(21) Appl. No.: 13/935,617

(22) Filed: Jul. 5, 2013

(65) Prior Publication Data

US 2015/0007861 A1 Jan. 8, 2015

(51) Int. Cl.
*A47L 15/20* (2006.01)
*A47L 15/42* (2006.01)

(52) U.S. Cl.
CPC ..... *A47L 15/20* (2013.01); *A47L 15/4278* (2013.01)

(58) Field of Classification Search
CPC ..... A47L 15/16; A47L 15/20; A47L 15/22; A47L 15/23; A47L 15/428; A47L 15/4278; A47L 15/4282
See application file for complete search history.

(56) References Cited

U.S. PATENT DOCUMENTS 3,210,010 A * 10/1965 Delapena ..... A47L 15/18 134/174
5,983,908 A * 11/1999 Bradley ..... A47L 15/20 134/186
7,231,929 B2 6/2007 Landsiedel et al.

FOREIGN PATENT DOCUMENTS

GB 2295535 A 6/1996

* cited by examiner

*Primary Examiner* — Jason Ko
*Assistant Examiner* — Spencer Bell
(74) *Attorney, Agent, or Firm* — Dority & Manning, P.A.

(57) ABSTRACT

The present subject matter provides a dishwasher appliance and a spray assembly for the same. The spray assembly includes a rotatable spray member, a biasing mechanism for rotating the spray member in a first rotational direction, and a plurality of nozzles mounted to the spray member. The plurality of nozzles is configured for directing wash fluid out of the spray member. The spray member rotates in a second rotational direction when wash fluid flows out of the plurality of nozzles.

10 Claims, 10 Drawing Sheets

SPRAY ASSEMBLY FOR A DISHWASHER APPLIANCE

FIELD OF THE INVENTION

The present subject matter relates generally to dishwasher appliances and spray assemblies for the same.

BACKGROUND OF THE INVENTION

Dishwasher appliances generally include a tub that defines a wash chamber for receipt of articles for washing. Certain dishwasher assemblies also include a rack assembly slidably mounted within the wash chamber. A user can load articles, such as plates, bowls, glasses, and/or cups, into the rack assembly, and the rack assembly can support such articles within the wash chamber during operation of the dishwasher appliance.

Certain dishwasher appliances also include spray arms for directing wash fluid onto articles within the wash chamber during operation of the dishwasher appliance. The spray arms are generally rotatably mounted with the wash chamber in order to improve wash fluid coverage of articles within the wash chamber. To assist with distributing wash fluid evenly within the wash chamber, the spray arms can include a lower spray arm position below a lower rack assembly, a middle spray arm positioned at a bottom of an upper rack assembly, and an upper spray arm positioned above the upper rack assembly. The lower spray arm is generally configured to clean articles within the lower rack assembly, and the middle and upper spray arms are generally configured to clean articles within the upper rack assembly.

During rotation, spray arms generally define a circular spray area. However, wash chambers generally have a rectangular or square cross-section. Thus, it can be difficult to direct wash fluid towards certain portions of the wash chamber with such rotating spray arms. Accordingly, a spray assembly for a dishwasher appliance with features for directing a uniform or even spray of wash fluid towards a rack assembly of the dishwasher appliance would be useful.

In addition, the middle spray arm can occupy a large volume of space within the tub. In particular, the middle spray arm can occupy a large volume of space between the lower and upper rack assemblies. Thus, the middle spray arm can negatively affect a dishwasher appliance consumer's impression of the dishwasher's capacity. In addition, large and/or tall articles positioned within the lower rack assembly can interfere with operation of the middle spray arm. In particular, the middle spray arm can impact large articles positioned within the lower rack assembly, and such articles can limit rotation of middle spray arm and impede operation of the dishwasher appliance.

Accordingly, a dishwasher appliance with features for assisting with preventing large articles positioned within a rack assembly of the dishwasher appliance from interfering with operation of the dishwasher appliance would be useful. In addition, a dishwasher appliance with features for assisting with providing a positive impression of a dishwasher appliance capacity to a dishwasher appliance consumer would be useful.

BRIEF DESCRIPTION OF THE INVENTION

The present subject matter provides a dishwasher appliance and a spray assembly for the same. The spray assembly includes a rotatable spray member, a biasing mechanism for rotating the spray member in a first rotational direction, and a plurality of nozzles mounted to the spray member. The plurality of nozzles is configured for directing wash fluid out of the spray member. The spray member rotates in a second rotational direction when wash fluid flows out of the plurality of nozzles. Additional aspects and advantages of the invention will be set forth in part in the following description, or may be apparent from the description, or may be learned through practice of the invention.

In a first exemplary embodiment, a spray assembly for a dishwasher appliance is provided. The spray assembly defines an axial direction, a radial direction, and a circumferential direction. The spray assembly includes a bracket and a spray member mounted to the bracket. The spray member is rotatable on an axis of rotation between a first position and a second position. The axis of rotation is substantially parallel to the axial direction. A biasing mechanism is positioned proximate the bracket and the spray member. The biasing mechanism is configured for urging the spray member towards the first position. A plurality of nozzles is mounted to the spray member. The nozzles of the plurality of nozzles are spaced apart from one another along axial direction on the spray member. Each nozzle of the plurality of nozzles is configured for directing a flow of wash fluid out of the spray member. The spray member rotates towards the second position if wash fluid is flowing out of the plurality of nozzles and the biasing mechanism urges the spray member towards the first position if wash fluid is not flowing out of the plurality of nozzles.

In a second exemplary embodiment, a dishwasher appliance is provided. The dishwasher appliance includes a tub that defines a wash chamber and a rack assembly positioned within the wash chamber of the tub. The rack assembly is configured for receipt of articles for washing. A spray assembly is positioned within the wash chamber of the tub. The spray assembly defines an axial direction, a radial direction, and a circumferential direction. The spray assembly includes a bracket mounted to the tub and a spray member rotatably mounted to the bracket. A biasing mechanism is positioned proximate the bracket and the spray member. The biasing mechanism is configured for rotating the spray member in a first rotational direction along the circumferential direction. A plurality of nozzles is mounted to the spray member. Nozzles of the plurality of nozzles are spaced apart from one another along axial direction. Each nozzle of the plurality of nozzles is configured for directing a flow of wash fluid out of the spray member such that the spray member rotates in a second rotational direction along the circumferential direction. The first rotational direction is opposite to the second rotational direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
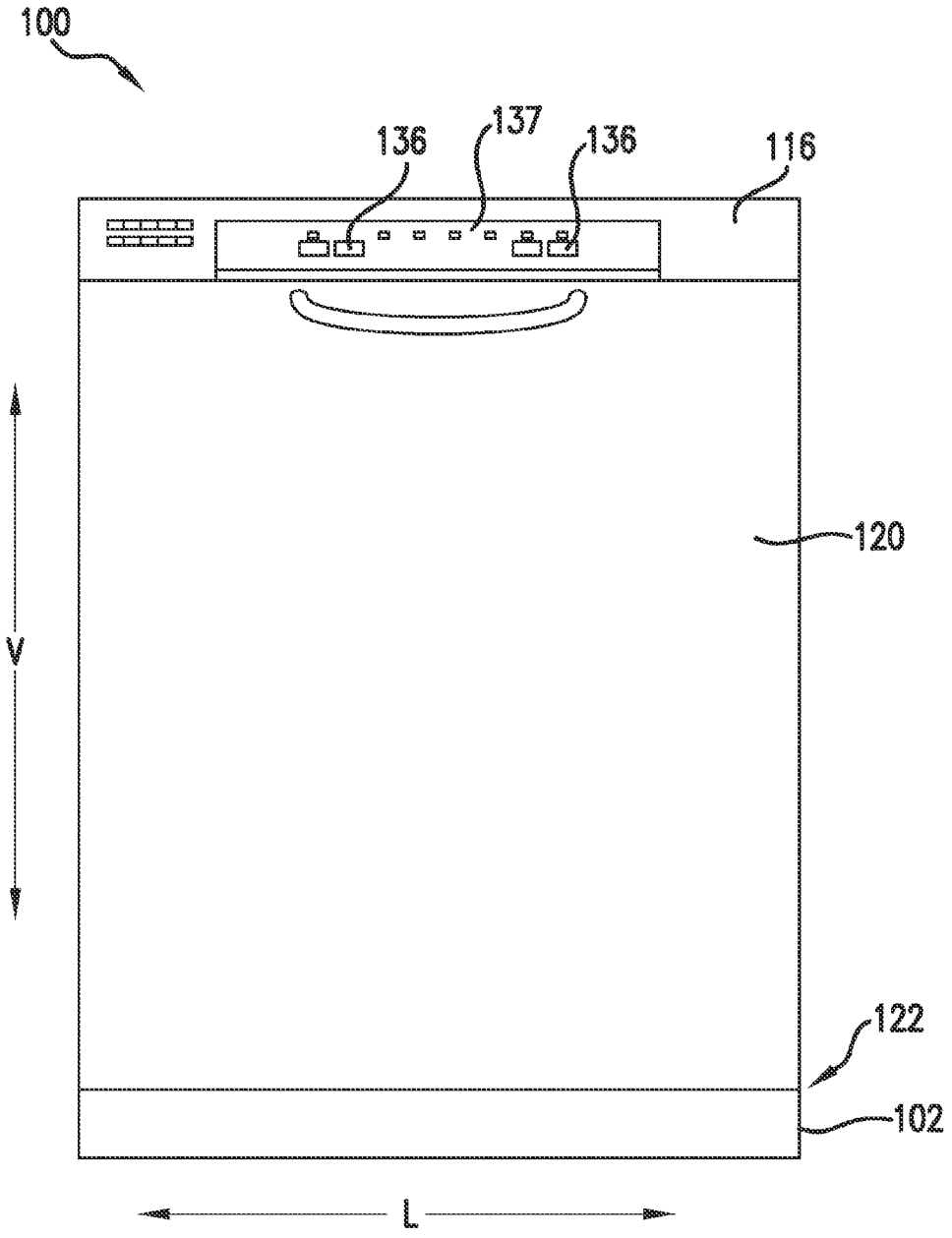
FIG. 1 provides a front, elevation view of a dishwasher appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
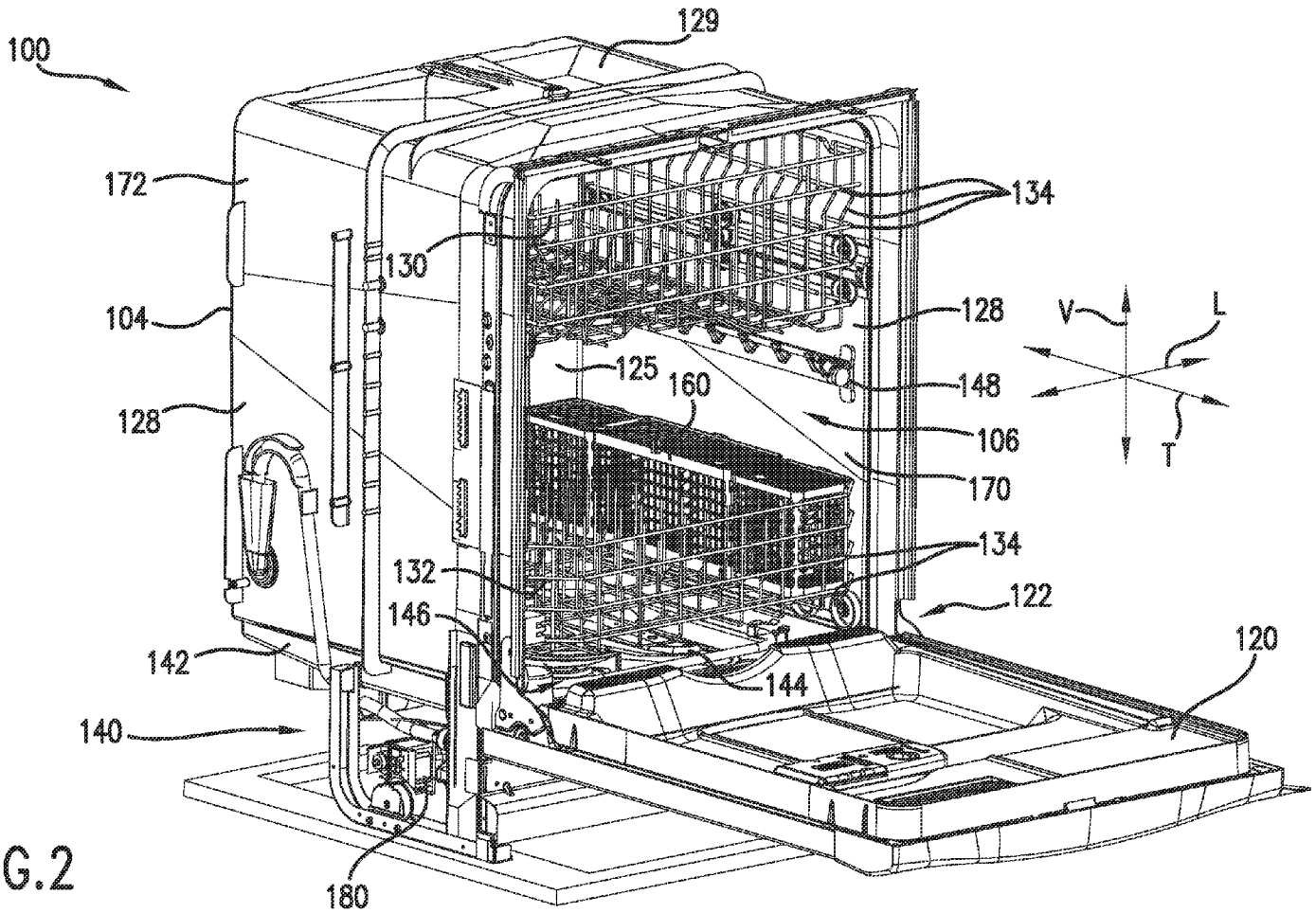
FIG. 2 provides a perspective view of the exemplary dishwasher appliance of FIG. 1 with a door of the exemplary dishwasher appliance shown in an open position to reveal a wash chamber of the exemplary dishwasher appliance.
Figure 3:
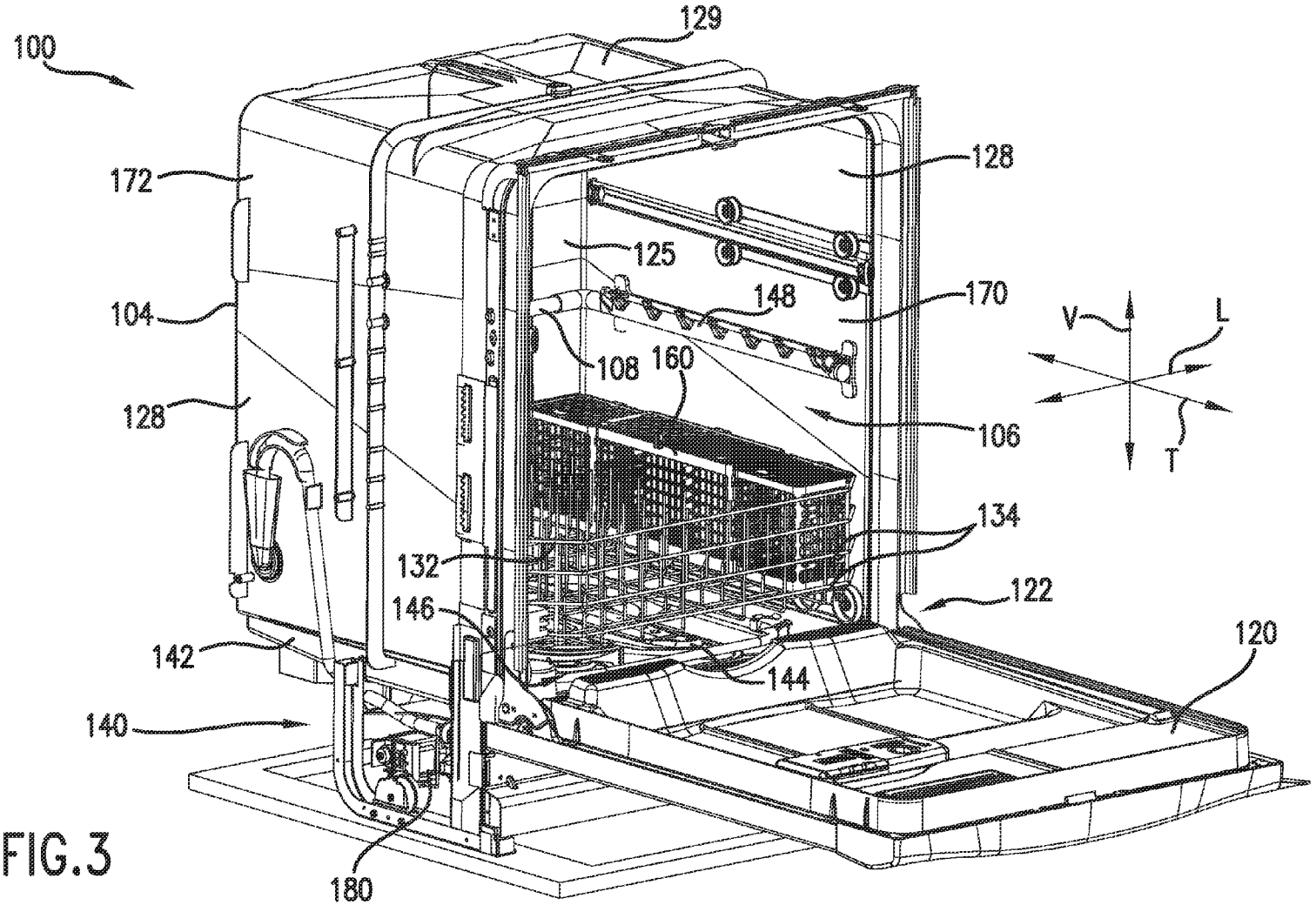
FIG. 3 provides a perspective view of the exemplary dishwasher appliance of FIG. 2 with an upper rack assembly of the exemplary dishwasher appliance removed from the wash chamber of the exemplary dishwasher appliance.

FIG. 1 provides a front, elevation view of a dishwasher appliance 100 according to an exemplary embodiment of the present subject matter. FIG. 2 provides a perspective view of dishwasher appliance 100 with a door 120 of dishwasher appliance 100 shown in an open position to reveal a wash chamber or compartment 106 of dishwasher appliance 100. FIG. 3 provides a perspective view of dishwasher appliance 100 with an upper rack assembly 130 of dishwasher appliance 100 removed from wash compartment 106 of dishwasher appliance 100. Dishwasher appliance 100 defines a vertical direction V, a lateral direction L, and a transverse direction T. Vertical direction V, lateral direction L, and transverse direction T are mutually perpendicular and form an orthogonal directional system.

Dishwasher appliance 100 includes a tub 104 that defines wash compartment 106. Tub 104 has a pair of sidewalls 128, a back wall 125, and a top wall 129 that assist with defining wash compartment 106. Sidewalls 128 are spaced apart from each other, e.g., along the lateral direction L. In particular, sidewalls 128 include a first sidewall 170 and a second sidewall 172. First and second sidewalls 170 and 172 are spaced apart from each other, e.g., along the lateral direction L. Back wall 125 and top wall 129 extend between and connect sidewalls 128, e.g., along the lateral direction L. Tub 104 also includes door 120 hinged at its bottom 122 for movement between a normally closed configuration (shown in FIG. 1) in which wash compartment 106 is sealed shut, e.g., for washing operation, and an open configuration (shown in FIGS. 2 and 3) for loading and unloading of articles from dishwasher appliance 100.

Turning to FIG. 2, tub sidewalls 128 accommodate upper and lower roller-equipped rack assemblies 130, 132. Each of the upper and lower racks assemblies 130, 132 is fabricated from lattice structures that include a plurality of wires or elongated members 134. Each rack assembly 130, 132 is adapted for movement between an extended loading position (not shown) in which the rack assembly is substantially positioned outside the wash compartment 106, and a retracted position (shown in FIGS. 1 and 2) in which the rack assembly is located inside the wash compartment 106.

A silverware basket 160 is removably mounted to lower rack assembly 132. However, silverware basket 160 may also be selectively attached to other portions of dishwasher appliance 100, e.g., upper rack assembly 130 or door 120. Silverware rack 160 is configured for receipt of silverware, utensils, and the like, that are too small to be accommodated by the upper and lower racks assemblies 130, 132.

The dishwasher appliance 100 further includes a lower spray assembly 144 that is mounted within a lower region 146 of the wash compartment 106 and above a tub sump portion 142 so as to be in relatively close proximity to the lower rack assembly 132. A mid-level spray assembly 148 is located in an upper region of the wash compartment 106 and may be located in close proximity to upper rack assembly 130. Additionally, an upper spray assembly (not shown) may be located above the upper rack assembly 130 and mounted to top wall 129 of tub 104.

Mid-level spray assembly 148 is mounted to one of sidewalls 128. In particular, mid-level spray assembly 148 is positioned below upper rack assembly 130, e.g., along the vertical direction V, and is mounted to first sidewall 170. As will be understood by those skilled in the art, dishwasher appliance 100 also includes an additional mid-level spray assembly (not shown) that is positioned below upper rack assembly 130, e.g., along the vertical direction V, and is mounted to second sidewall 172. The additional mid-level spray assembly may be substantially similar to mid-level spray assembly 148. In alternative exemplary embodiments, mid-level spray assembly 148 may be mounted to back wall 125, to top wall 129, on any other suitable component of tub 104, or on upper rack assembly 130. Mid-level spray assembly 148 and the additional mid-level spray assembly on second sidewall 172 can rotate to during operation of dishwasher appliance 100 to assist with evenly or uniformly applying wash fluid to articles within upper rack assembly 130 and/or lower rack assembly 132.

The lower and mid-level spray assemblies 144, 148 and the upper spray assembly are fed by a pump 180 for circulating water and wash fluid (e.g., detergent, water, and/or rinse aid) in the tub 104. Pump 180 is located in a machinery compartment 140 located below the bottom sump portion 142 of the tub 104, as generally recognized in the art. A conduit or circulation piping 108 directs water and/or wash fluid from pump 180 to lower spray assembly 144 and mid-level spray assembly 148.

Each spray assembly includes an arrangement of discharge ports or orifices for directing wash fluid onto dishes or other articles located in the upper and lower rack assemblies 130, 132 and silverware basket 160. Lower spray assembly 144 is rotatably mounted in wash compartment 106. Accordingly, the arrangement of the discharge ports on lower spray assembly 144 may provide a rotational force by virtue of washing fluid flowing through the discharge ports. The resultant rotation of the lower spray assembly 144 can provide coverage of dishes and other dishwasher contents with a washing spray.

The dishwasher appliance 100 is further equipped with a controller 137 to regulate operation of the dishwasher appliance 100. Controller 137 may include a memory and microprocessor, such as a general or special purpose microprocessor operable to execute programming instructions or micro-control code associated with a cleaning cycle. The memory may represent random access memory such as DRAM, or read only memory such as ROM or FLASH. Alternatively, controller 137 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 137 may be positioned in a variety of locations throughout dishwasher appliance 100. In the illustrated embodiment, controller 137 is located within a control panel 116 of door 120. Typically, controller 137 includes a user interface panel 136 through which a user may select various operational features and modes and monitor progress of the dishwasher appliance 100. In one exemplary embodiment, user interface 136 represents a general purpose I/O ("GPIO") device or functional block. In another exemplary embodiment, user interface 136 includes input components, such as one or more of a variety of electrical, mechanical or electromechanical input devices including rotary dials, push buttons, and touch pads. User interface 136 may include a display component, such as a digital or analog display device designed to provide operational feedback to a user.

It should be appreciated that the present subject matter is not limited to any particular style, model, or other configuration of dishwasher appliance and that dishwasher appliance 100 depicted in FIGS. 1 and 2 is provided for illustrative purposes only. For example, the present subject matter may be used in dishwasher appliances having other rack configurations.

Figure 4:
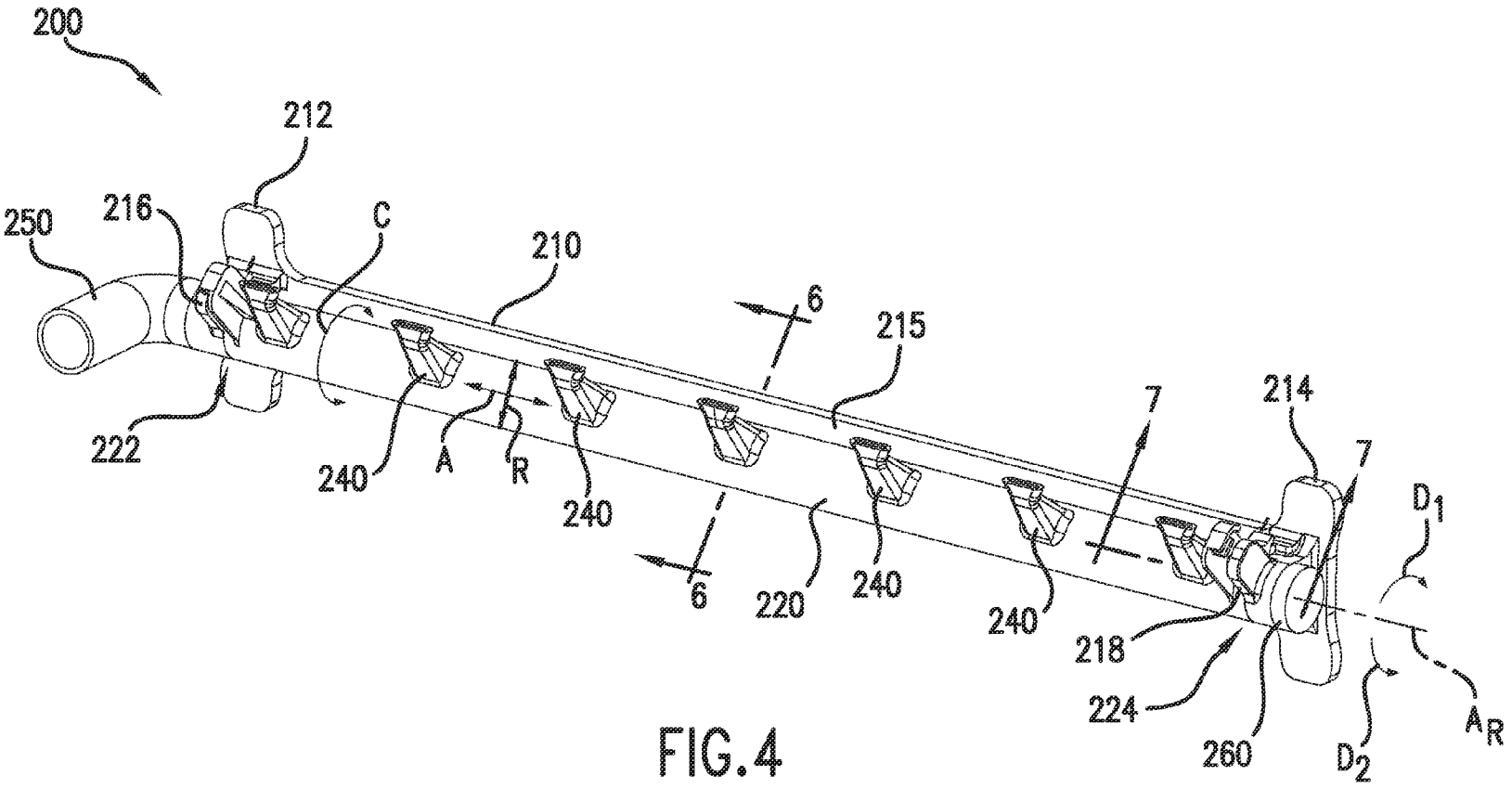
FIG. 4 provides a perspective view of a spray assembly according to an exemplary embodiment of the present subject matter.
Figure 5:
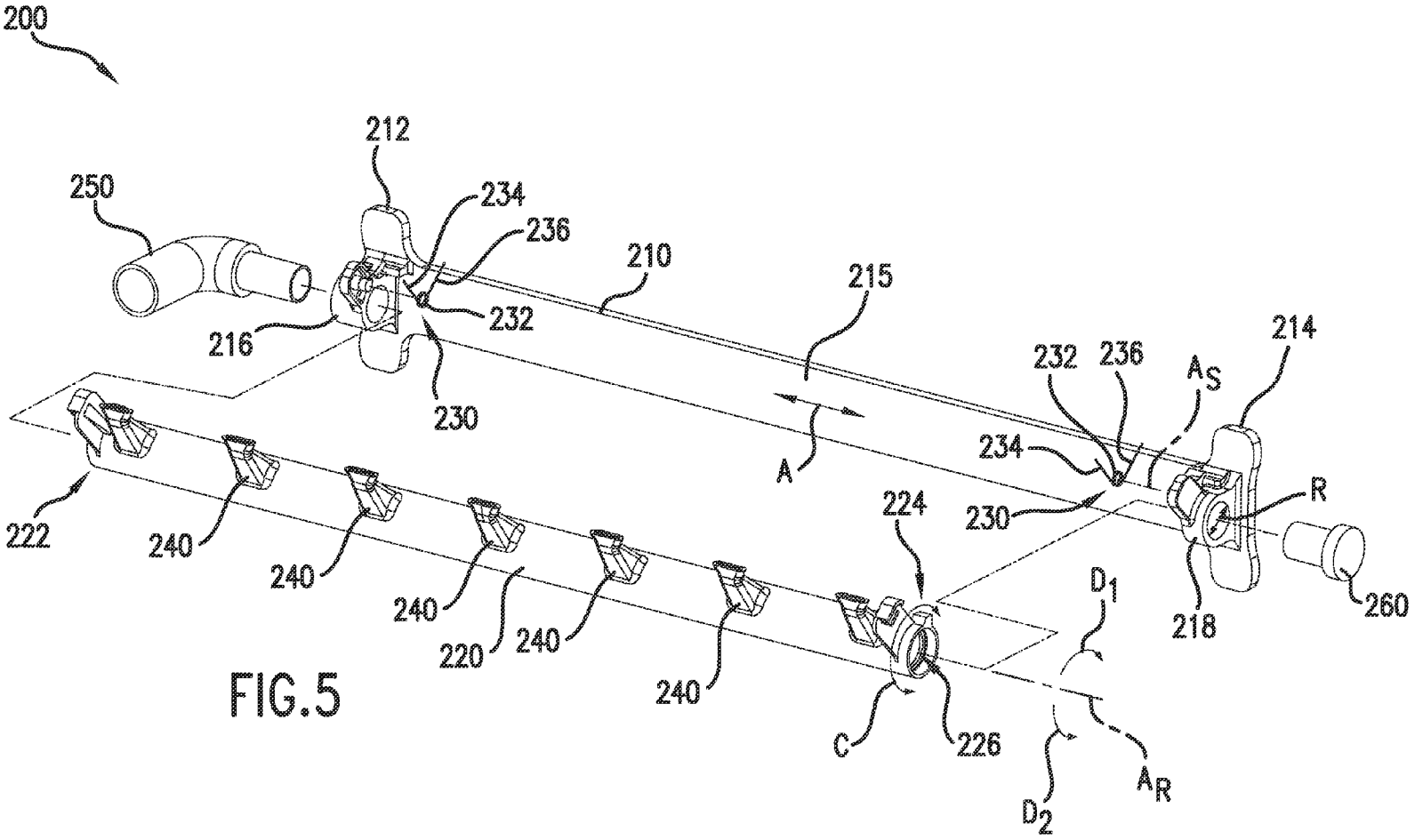
FIG. 5 provides an exploded view of the exemplary spray assembly of FIG. 4.

FIG. 4 provides a perspective view of a spray assembly 200 according to an exemplary embodiment of the present subject matter. FIG. 5 provides an exploded view of spray assembly 200. Spray assembly 200 may be used in any suitable dishwasher appliance. As an example, spray assembly 200 may be used in dishwasher appliance 100 (FIG. 1) as mid-level spray assembly 148 (FIG. 3), the additional mid-level spray assembly or the upper level spray assembly. Spray assembly 200 defines an axial direction A, a radial direction R, and a circumferential direction C. In certain exemplary embodiments, the axial direction A may be substantially parallel to the lateral direction L (FIG. 3) or the transverse direction T (FIG. 3) of dishwasher appliance 100 depending upon the location and orientation of spray assembly 200 within wash compartment 106 of tub 104.

Spray assembly 200 includes a bracket 210. Bracket 210 may be mounted to tub 104, e.g., first sidewall 170, second sidewall 172, top wall 129, back wall 125, or on upper rack assembly 130 in order to mount spray assembly 200 within wash compartment 106 of tub 104. Bracket 210 includes a first portion 212 and a second portion 214 spaced apart from each other, e.g., along the axial direction A. Bracket 210 also includes a plate 215 that extends between and couples first and second portions 212 and 214 of bracket 210 together. In alternative exemplary embodiments, bracket 210 need not include plate 215. Thus, bracket 210 may include only first portion 212 and second portion 214, and first and second portions 212 and 214 may be mounted to tub 104, e.g., such that first and second portions 212 and 214 are axially aligned. Bracket 210 may be constructed with any suitable material, such as molded plastic.

Spray assembly 200 also includes a spray body or spray member 220. Spray member 220 is, e.g., rotatably, mounted to bracket 210. In particular, a first support 216 of bracket 210 is positioned at or proximate first portion 212 of bracket 210, and a second support 218 of bracket 210 is positioned at or proximate second portion 214 of bracket 210. Thus, first and second supports 216 and 218 of bracket 210 are spaced apart from each other, e.g., along the axial direction A. Spray member 220 extends, e.g., linearly, between a first end portion 222 and a second end portion 224, e.g., along the axial direction A. Spray member 220 is rotatably mounted to first support 216 at first end portion 222 of spray member 220. Spray member 220 is also rotatably mounted to second support 218 at second end portion 224 of spray member 220. Like bracket 210, spray member 220 may be constructed with any suitable material, such as molded plastic.

Spray member 220 also defines a chamber 226 (FIG. 5) for receipt of wash fluid. Thus, spray member 220 can be constructed as a substantially hollow tube. A conduit 250 is mounted to spray member 220 at first end portion 222 of spray member 220. Conduit 250 directs wash fluid into chamber 226 of spray member 220. For example, during operation of dishwasher appliance 100 (FIG. 2), pump 180 can urge wash fluid through conduit 250 into chamber 226 of spray member 220. Conduit 250 also assists with rotatably mounting spray member 220 to bracket 210. In particular, conduit 250 extends, e.g., along the axial direction A, through first support 216 of bracket 210 into chamber 226 of spray member 220.

A plurality of nozzles 240 is mounted to spray member 220. Nozzles 240 are spaced apart from one another along axial direction A on spray member 220 such that nozzles 240 are distributed along the axial direction A on spray member 220 between about first and second end portions 222 and 224 of spray member 220. Each nozzle of nozzles 240 can be mounted individually on spray member 220 such that each nozzle is independent during operation of washing machine appliance 100. Each nozzle of nozzles 240 is configured for directing a flow of wash fluid out of spray member 220, e.g., out of chamber 226 of spray member 220. As an example, during operation of dishwasher appliance 100 (FIG. 2), pump 180 can urge wash fluid through conduit 250 into chamber 226 of spray member 220 and out of spray member 220 through nozzles 240.

As shown in FIG. 5, spray assembly 200 further includes a biasing mechanism 230. Biasing mechanism 230 is positioned proximate bracket 210 and spray member 220. In particular, biasing mechanism 230 is mounted to bracket 210 and/or spray member 220. As discussed in greater detail below, biasing mechanism 230 is configured for urging or rotating spray member 220 in a particular rotational direction. Biasing mechanism 230 can be any suitable mechanism for urging or rotating spray member 220 in a particular rotational direction. For example, in the exemplary embodiment shown in FIGS. 4 and 5, biasing mechanism 230 includes torsion springs 232. Each torsion spring 232 has a first leg 234 mounted to spray member 220 and a second leg 236 mounted to bracket 210. An axis $A_S$ of torsion springs 230 is substantially parallel to an axis of rotation $A_R$ of spray member 220. Torsion springs 232 are charged by rotation of spray member 220 relative to bracket 210, e.g., first leg 234 of torsion spring 232 relative to second leg 236 of torsion spring 232. In alternative exemplary embodiments, any other type of mechanism, such as a spring, an elastic material, a diaphragm, magnetic material, or a counter-weight, may be used to urge or rotate spray member 220 in a particular rotational direction.

As discussed above, spray member 220 is rotatably mounted to bracket 210. In particular, spray member 220 is rotatable on axis of rotation $A_R$, e.g., relative to bracket 210. For example, spray member 220 is rotatable in a first rotation direction $D_1$ and a second rotational direction $D_2$ on the axis of rotation $A_R$ where the first and second rotation directions $D_1$ and $D_2$ are opposite to each other. The axis of rotation $A_R$ may be substantially parallel to the axial direction A.

By rotating on the axis of rotation $A_R$, spray member 220 may be selective rotated between a first position and a second position, e.g., along the circumferential direction C. Spray member 220 rotates towards the second position when the flow of wash fluid out of spray member 220 through nozzles 240 is initiated, and biasing mechanism 230 urges spray member 220 towards the first position when the flow of wash fluid out of the spray member 220 through nozzles 240 is terminated. As an example, spray member 220 is shown in the first position in FIG. 3. From the first position shown in FIG. 3, spray member 220 may be rotated in the second rotational direction $D_2$ on the axis of rotation $A_R$ such that spray member 220 rotates towards the second position. In particular, wash fluid exiting nozzles 240 can apply sufficient force to spray member 220 to rotate spray member 220 from the first position shown in FIG. 3 to the second position.

With spray member 220 in the second position, biasing mechanism 230 can return spray member 220 to the first position because biasing mechanism 230 is configured for urging spray member 220 in the in the first rotational direction $D_1$ on the axis of rotation $A_R$ towards the first position. As an example, when wash fluid stops flowing out of spray member 220, biasing mechanism 230 can rotate spray member 220 in the first rotational direction $D_1$ from the second position towards the first position in order to return spray member 220 to the first position shown in FIG. 4. Such actions can be repeated in order to create an oscillating motion of spray member 220 between the first and second positions.

In the exemplary embodiment shown in FIGS. 4 and 5, torsion springs 232 apply a torque to spray member 220 in order to selectively rotate spray member 220. In particular, a magnitude of the torque applied by torsion springs 232 is less than a magnitude of a force applied to spray member 220 by wash fluid exiting nozzles 240. Thus, spray member 220 rotates from the first position towards the second position after wash fluid begins exiting nozzles 240 because the force applied to spray member 220 by wash fluid exiting nozzles 240 is greater than the magnitude of the torque applied by torsion springs 232. Similarly, spray member 220 rotates from the second position towards the first position after wash fluid stops exiting nozzles 240 due to the torque applied to spray member 220 by torsion springs 232.

In such manner, spray member 220 is selectively rotatable relative to bracket 210. During rotation of spray member 220, fluid exiting spray member 220 220 via nozzles 240 can be directed to various portions of upper rack assembly 130 (FIG. 2). Thus, rotation of spray member 220 can assist with uniformly applying wash fluid to articles within upper rack assembly 130. Similarly, spray member 220 can assist with washing articles in lower rack assembly 132, e.g., when spray assembly 200 is directed or oriented towards lower rack assembly 132.

The first and second positions of spray member 220 can have any suitable angle therebetween e.g., in a plane that is perpendicular to the axial direction A. For example, the first position of spray member 220 and the second position of spray member 220 may be spaced apart from each other by about forty-five degrees along the circumferential direction C. As another example, the first position of spray member 220 and the second position of spray member 220 may be spaced apart from each other by between about twenty-five degrees and about sixty-five degrees along the circumferential direction C. As yet another example, the first position of spray member 220 and the second position of spray member 220 may be spaced apart from each other by between about ten degrees and about one hundred and eighty degrees along the circumferential direction C.

When spray assembly 200 is used in dishwasher appliance 100 (FIG. 2), pump 180 is in fluid communication with conduit 250 and is configured for selectively urging wash fluid through conduit 250 into chamber 226 of spray member 220. Thus, pump 180 can selectively rotate spray member 220. In particular, spray member 220 rotates in the second rotational direction $D_2$ on the axis of rotation $A_R$ after pump 180 is activated and wash fluid is flowing out of nozzles 240. Similarly, spray member 220 rotates in the first rotational direction $D_1$ on the axis of rotation $A_R$ after pump 180 is deactivated and wash fluid stops flowing out of nozzles 240 due to biasing mechanism 230.

Figure 6:
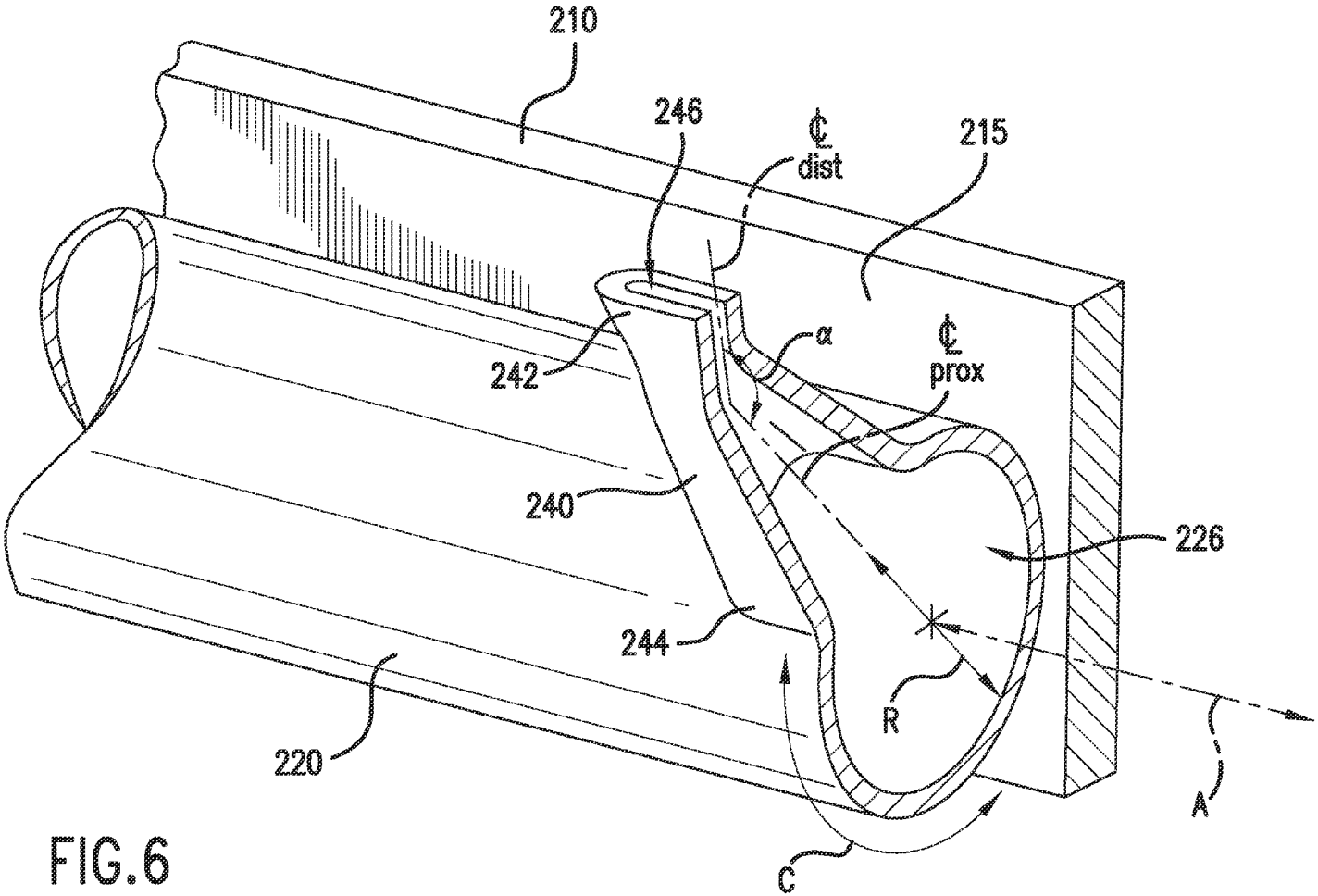
FIG. 6 provides a partial, section view of the exemplary spray assembly of FIG. 4 taken along the 6-6 line of FIG. 4.

FIG. 6 provides a partial, section view of spray assembly 200 taken along the 6-6 line of FIG. 4. As may be seen in FIG. 6, each nozzle of nozzles 240 extends between a distal portion 242 and a proximal portion 244, e.g., along the radial direction R. Proximal portion 244 of each nozzle 240 is positioned adjacent spray member 220. Conversely, distal portion 242 of each nozzle 240 is spaced apart from spray member 220, e.g., along the radial direction R.

Each nozzle of nozzles 240 also defines an outlet 246, e.g., at distal portion 242 of each nozzle 240. Outlet 246 of each nozzle 240 is in fluid communication with chamber 226 of spray member 220 and is configured for directing wash fluid out of chamber 226 of spray member 220. The orientation of distal portion 242 of each nozzle 240 and proximal portion 244 of each nozzle 240 relative to each other can assist with directing wash fluid uniformly, e.g., onto articles within upper rack assembly 130 (FIG. 2). In particular, distal portion 242 of at least one nozzle 240 defines a centerline $\mathfrak{C}_{dist}$. Similarly, proximal portion 244 of at least one nozzle 240 also defines a centerline $\mathfrak{C}_{prox}$. The centerline $\mathfrak{C}_{dist}$ of the distal portion 242 and the centerline $\mathfrak{C}_{prox}$ of the proximal portion 244 define an angle $\alpha$ therebetween, e.g., in a plane that is perpendicular to the axial direction A. The angle $\alpha$ can be any suitable angle. For example, the angle $\alpha$ may be greater than about ten degrees and less than about one hundred and eighty degrees, greater than about ten degrees and less than about forty degrees, or about twenty-five degrees.

Figure 7:
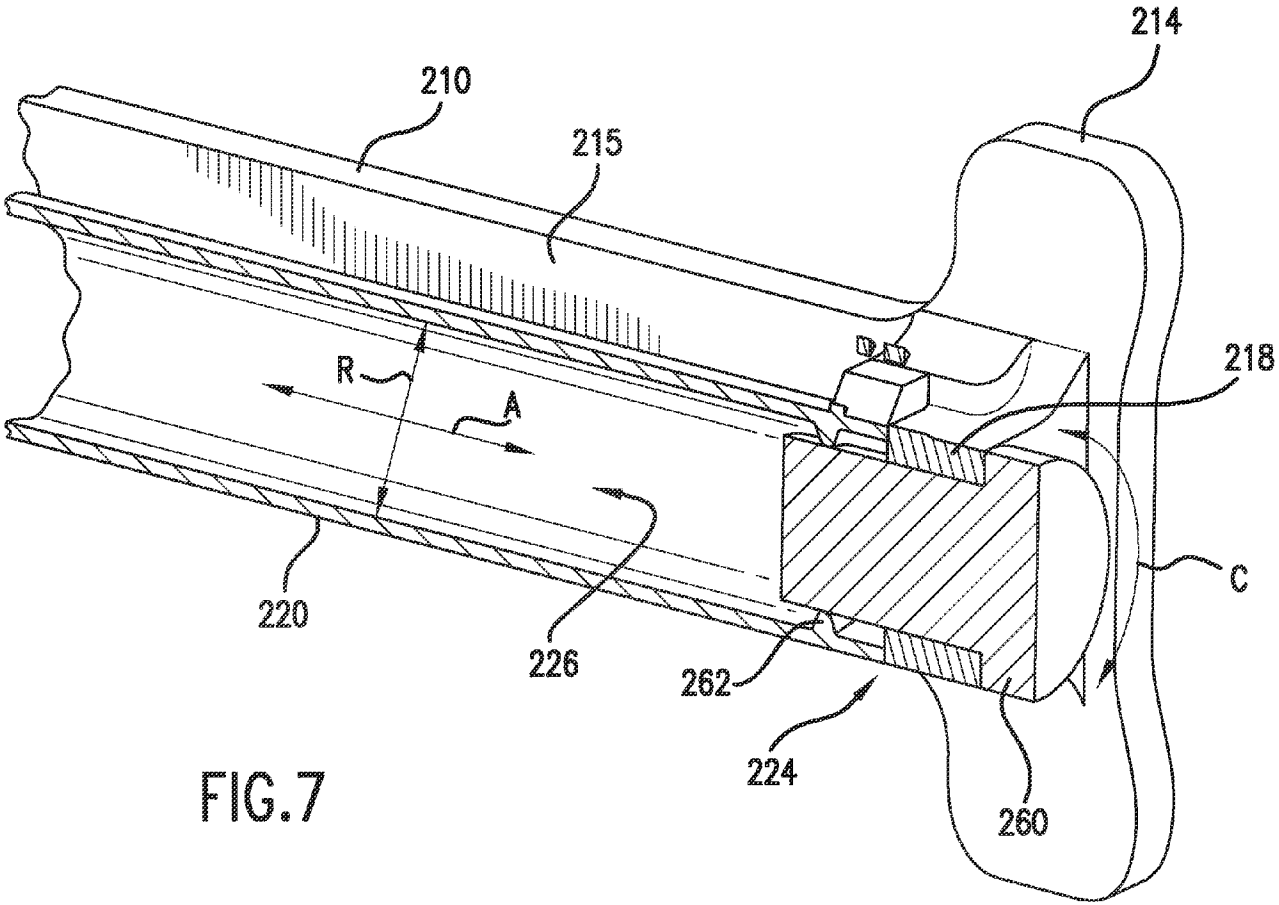
FIG. 7 provides a partial, section view of the exemplary spray assembly of FIG. 4 taken along the 7-7 line of FIG. 4.

FIG. 7 provides a partial, section view of spray assembly 200 taken along the 7-7 line of FIG. 4. As may be seen in FIG. 7, spray assembly 200 includes a plug 260 positioned at or proximate second support 218 of bracket 210 and second end portion 224 of spray member 220. Plug 260 assists with rotatably mounting spray member 220 to bracket 210. In particular, plug 260 extends, e.g., along the axial direction A, through second support 218 of bracket 210 into chamber 226 of spray member 220. A flange 262 mounted to spray member 220 and positioned within chamber 226 of spray member 220 engages plug 260 in order to assist with sealing chamber 226 of spray member 220 and hindering leakage of wash fluid at second end portion 224 of spray member 220. In particular, flange 262 extends from spray member 220 to plug 260, e.g., along the radial direction R, and extends about plug 260, e.g., along circumferential direction C. Thus, plug 260 assists with hindering leaks and also with rotatably mounting spray member 220 to bracket 210. Conduit 250 can similarly engage spray member 220 at first end portion 222 of spray member 220 in order to assist with hindering leaks and also with rotatably mounting spray member 220 to bracket 210.

Figure 8:
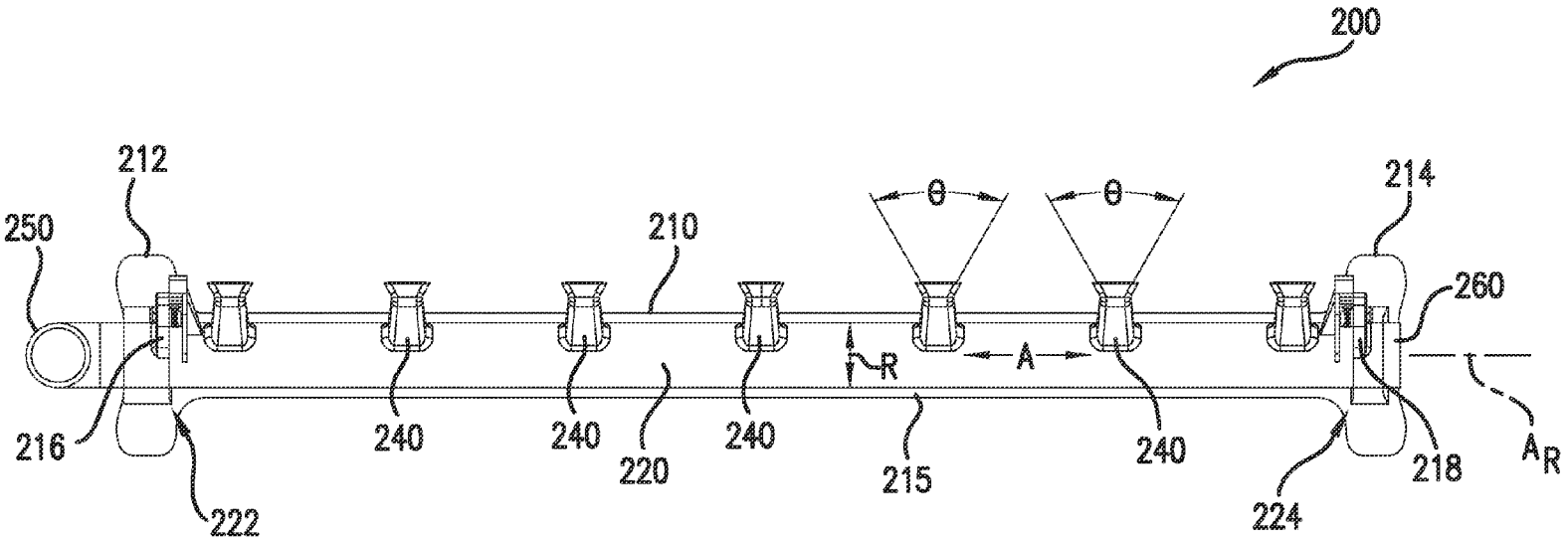
FIG. 8 provides a side, elevation view of the exemplary spray assembly of FIG. 4.
Figure 9:
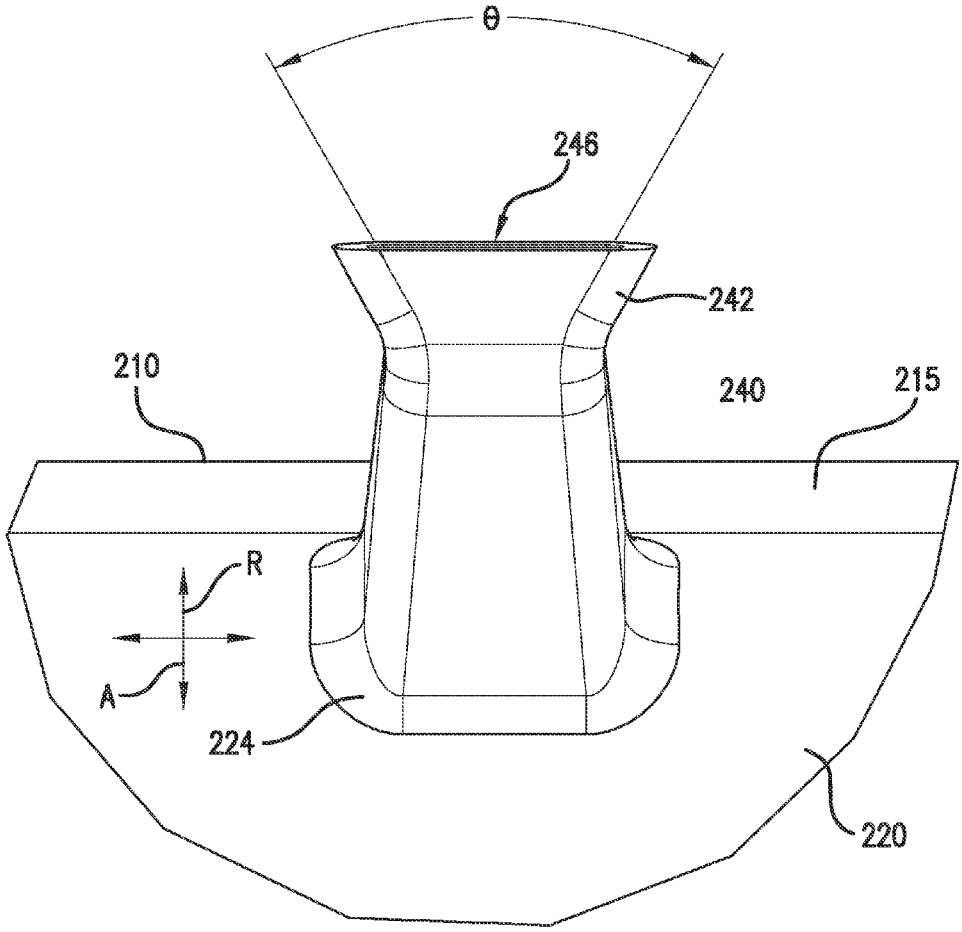
FIG. 9 provides a partial, elevation view of the exemplary spray assembly of FIG. 4.

FIG. 8 provides a side, elevation view of spray assembly 200. FIG. 9 provides a partial, elevation view of spray assembly 200. As may be seen in FIGS. 8 and 9, proximal portions 244 of nozzles 240 have a converging cross-section, e.g., in a plane that is perpendicular to the radial direction R. Thus, fluids flowing through proximal portions 244 of nozzles 240 can increase in velocity and decrease in pressure. Conversely, distal portions 242 of nozzles 240 have a diverging cross-section, e.g., in a plane that is perpendicular to the radial direction R. Thus, fluids flowing through distal portions 242 of nozzles 240 can increase in pressure and decrease in velocity. Proper selection of the diverging cross-section of distal portions 242 of nozzles 240 can assist with providing uniform wash fluid coverage onto articles within dishwasher appliance 100 while also permitting oscillation of spray member 220 between the first and second positions.

The diverging cross-section of distal portions 242 of nozzles 240 can define an angle θ. The angle θ can be any suitable angle. For example, the angle θ may be greater than about ten degrees and less than about one hundred and forty degrees, greater than about ten degrees and less than about ninety degrees, or about sixty degrees. Wash fluid exiting nozzles 240 can diverge at about the angle θ. As shown in FIG. 8 and will be understood by those skilled in the art, angle θ may be selected such that fluid streams from nozzles 240 intersect at about a target of spray assembly 200, e.g., upper rack assembly 130 or lower rack assembly 132 of dishwasher appliance 100. Thus, selection of angle θ can assist with providing uniform wash fluid coverage onto articles within dishwasher appliance 100.

Figure 10:
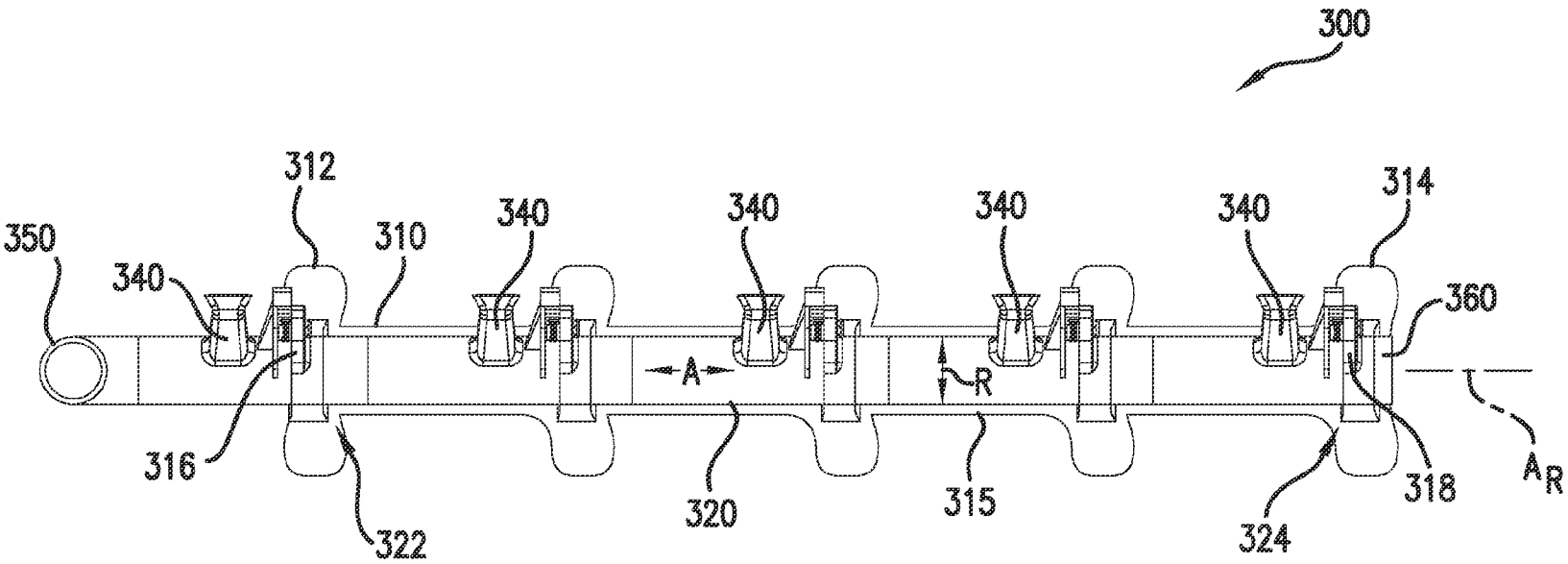
FIG. 10 provides a side, elevation view of a spray assembly according to an additional exemplary embodiment of the present subject matter.

FIG. 10 provides a side, elevation view of a spray assembly 300 according to an additional exemplary embodiment of the present subject matter. Spray assembly 300 includes similar components as spray assembly 200 (FIG. 8). For example, spray assembly 300 includes a bracket 310 with a first portion 312, a second portion 314, a plate 315, a first support 316, and a second support 318, a spray member 320 that extends between a first end portion 322 and a second end portion 324, nozzles 340, a conduit 350, and a plug 360. As may be seen in FIG. 10, spray member 320 is segmented such that each nozzle of nozzles 340 can rotate independently on the axis of rotation $A_R$. In such a manner, nozzles 340 can be mounted individually on spray member 320, e.g., such that nozzles 340 are independent of one another.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance, comprising:

a tub defining a wash chamber;

a rack assembly positioned within the wash chamber of the tub, the rack assembly configured for receipt of articles for washing; and a spray assembly positioned within the wash chamber of the tub, the spray assembly defining an axial direction, a radial direction, and a circumferential direction, the spray assembly comprising a bracket mounted to the tub;

a spray member rotatably mounted to the bracket;

a biasing mechanism positioned proximate the bracket and the spray member, the biasing mechanism configured for rotating the spray member in a first rotational direction along the circumferential direction; and a plurality of nozzles mounted to the spray member and spaced apart from one another along the axial direction, each nozzle of the plurality of nozzles configured for directing a flow of wash fluid out of the spray member such that the spray member rotates in a second rotational direction along the circumferential direction, the first rotational direction being opposite to the second rotational direction, wherein the biasing mechanism comprises a torsion spring having a first leg mounted to the spray member and a second leg mounted to the bracket, the torsion spring charged by rotation of the spray member in the second rotational direction.

2. The dishwasher appliance of claim 1, wherein the tub comprises a back wall and a pair of sidewalls, the back wall extending between and connecting the pair of sidewalk along a lateral direction, the bracket of the spray assembly mounted to the back wall of the tub.

3. The dishwasher appliance of claim 2, wherein the spray assembly is positioned below the rack assembly along a vertical direction, each nozzle of the plurality of nozzles configured for directing the flow of wash fluid out of the spray member towards the rack assembly.

4. The dishwasher appliance of claim 1, wherein the tub comprises a back wall and a pair of sidewalls, the back wall extending between and connecting the pair of sidewalls along a lateral direction, the spray assembly positioned on a first one of the pair of sidewalls of the tub, the bracket of the spray assembly mounted to the first one of the pair of sidewalls of the tub.

5. The dishwasher appliance of claim 4, wherein the spray assembly is positioned below the rack assembly along a vertical direction, each nozzle of the plurality of nozzles configured for directing the flow of wash fluid out of the spray member towards the rack assembly.

6. The dishwasher appliance of claim 4, further comprising an additional spray assembly mounted to the tub and positioned on a second one of the pair of sidewalls, the additional spray assembly comprising a bracket mounted to the second one of the pair of sidewalls of the tub;

a spray member rotatably mounted to the bracket of the additional spray assembly;

a biasing mechanism positioned proximate the bracket of the additional spray assembly and the spray member of the additional spray assembly, the biasing mechanism of the additional spray assembly configured for rotating the spray member of the additional spray assembly in the second rotational direction; and a plurality of nozzles mounted to the spray member of the additional spray assembly and spaced apart from each other along axial direction on the spray member of the additional spray assembly, each nozzle of the plurality of nozzles of the additional spray assembly configured for directing a flow of wash fluid out of the spray member of the additional spray assembly, the flow of wash fluid out of each nozzle of the plurality of nozzles of the additional spray assembly rotating the spray member of the additional spray assembly in the first rotational direction.

7. The dishwasher appliance of claim 1, wherein the spray member extends between a first end portion and a second end portion along the axial direction and the spray member defines a chamber for receipt of wash fluid, a conduit mounted to the spray member at the first end portion of the spray member for directing wash fluid into the chamber of the spray member.

8. The dishwasher appliance of claim 7, further comprising a pump in fluid communication with the conduit, the pump configured for selectively urging wash fluid through the conduit into the chamber of the spray member in order to generate an oscillating motion wash spray within the wash chamber of the tub.

9. The dishwasher appliance of claim 8, wherein the spray member rotates in the second rotational direction after the pump is activated and the spray member rotates in the first rotational direction after the pump is deactivated.

10. The dishwasher appliance of claim 1, further comprising a spray arm positioned below to the rack assembly, the spray arm configured for directing wash fluid onto articles positioned within the rack assembly.

* * * * *